US011648576B2

(12) United States Patent
Zandonà

(10) Patent No.: US 11,648,576 B2
(45) Date of Patent: May 16, 2023

(54) DEVICE FOR DISPENSING FLUIDS OR MIXTURES

(71) Applicant: TAPLAST S.R.L., Vicenza (IT)

(72) Inventor: Raffele Zandonà, San Pietro in Gu (IT)

(73) Assignee: TAPLAST S.R.L.

( * ) Notice: Subject to any disclaimer, the term of this patent is extended or adjusted under 35 U.S.C. 154(b) by 0 days.

(21) Appl. No.: 17/421,426

(22) PCT Filed: Dec. 30, 2019

(86) PCT No.: PCT/IB2019/061431
§ 371 (c)(1),
(2) Date: Jul. 8, 2021

(87) PCT Pub. No.: WO2020/144532
PCT Pub. Date: Jul. 16, 2020

(65) Prior Publication Data

US 2022/0118469 A1 Apr. 21, 2022

(30) Foreign Application Priority Data

Jan. 8, 2019 (IT) ..... 102019000000199

(51) Int. Cl.
*B05B 11/00* (2006.01)

(52) U.S. Cl.
CPC ..... *B05B 11/3032* (2013.01); *B05B 11/007* (2013.01); *B05B 11/0094* (2013.01);
(Continued)

(58) Field of Classification Search
CPC ..... B05B 11/3032; B05B 11/007; B05B 11/0094; B05B 11/113047; B05B 11/306; B05B 11/3067
See application file for complete search history.

(56) References Cited

U.S. PATENT DOCUMENTS 2,884,164 A 4/1959 Kleid
4,369,899 A 1/1983 Magers
(Continued)

FOREIGN PATENT DOCUMENTS

CN 101111433 A 1/2008
EP 1818107 8/2007
WO 2002004129 A1 1/2002

OTHER PUBLICATIONS

Patent Cooperation Treaty (PCT), International Search Report and Written Opinion for Application PCT/IB2019/061431 filed Dec. 30, 2019, dated May 4, 2020, International Searching Authority, IB.
(Continued)

*Primary Examiner* — Vishal Pancholi
(74) *Attorney, Agent, or Firm* — McDonald Hopkins LLC

(57) ABSTRACT

The present invention concerns a device (1) for dispensing a fluid (L), suited to be coupled with a container (C) holding said fluid (L). The device (1) comprises a collapsible chamber (6) suited to draw, contain and dispense an amount of said fluid (L) and at least partially delimited by a deformable membrane (10) suited to be squeezed to dispense at least one portion of said amount from the collapsible chamber (6). The device (1) comprises locking means (50, 52, 56) suited to maintain the deformable membrane (10) in a fixed squeezed position and release means (80, 84*a*, 84*b*, 86*a*, 86*b*) suited to release the deformable membrane (10) from the fixed squeezed position.

12 Claims, 12 Drawing Sheets

(52) U.S. Cl.
CPC ..... *B05B 11/306* (2013.01); *B05B 11/3047* (2013.01); *B05B 11/3067* (2013.01)

(56) References Cited

U.S. PATENT DOCUMENTS

| | | | | | |
|---|---|---|---|---|---|
| 5,492,252 | A * | 2/1996 | Gueret | B05B 11/3001 | D9/503 |
| 5,501,375 | A * | 3/1996 | Nilson | B65D 25/465 | 222/394 |
| 5,871,126 | A * | 2/1999 | Bennett | B05B 11/3032 | 222/207 |
| 8,206,136 | B2 * | 6/2012 | Brouwer | B05B 11/3028 | 92/99 |
| 2007/0181611 | A1 * | 8/2007 | Julian Pidevall | B05B 11/3032 | 222/409 |
| 2010/0206910 | A1 * | 8/2010 | Carta | B05B 11/0044 | 222/207 |
| 2012/0091229 | A1 * | 4/2012 | Laidler | B05B 11/3033 | 222/207 |

OTHER PUBLICATIONS

Chinese Office Action dated May 30, 2022; Chinese Application No. 201980092912.7.
European Communication pursuant to Article 94(3) for Application No. 198507949.9, dated Aug. 4, 2022, 7 pages, European Patent Office, Germany.

* cited by examiner

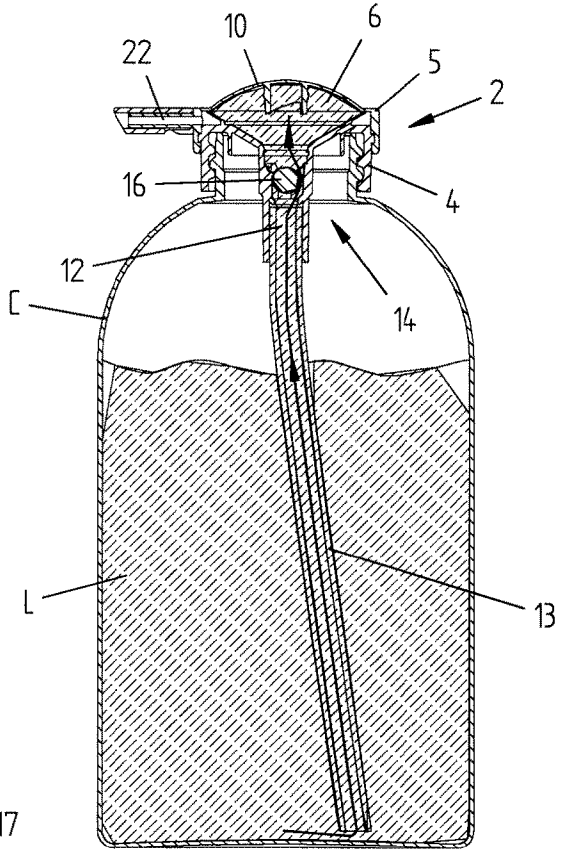
FIG. 17
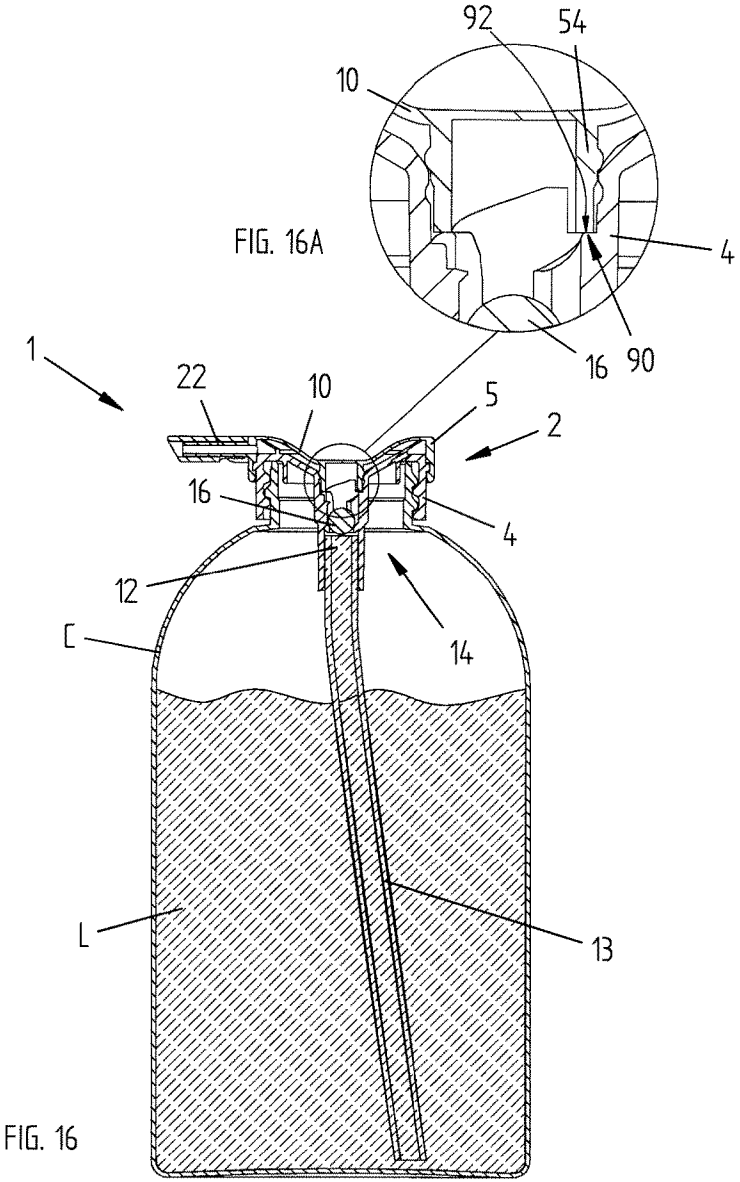
FIG. 16A
FIG. 16

DEVICE FOR DISPENSING FLUIDS OR MIXTURES

CROSS-REFERENCE TO RELATED APPLICATION

This application is a 35 U.S.C. 371 national stage filing of PCT Application No. PCT/IB2019/061431 filed Dec. 30, 2019, entitled "DEVICE FOR DISPENSING FLUIDS OR MIXTURES," which claims priority to Italian Patent Application No. 102019000000199 filed on Jan. 8, 2019, each of which are incorporated herein in their entirety by reference.

TECHNICAL FIELD OF THE INVENTION

The present invention lies in the technical field of the delivery systems of fluids or mixtures thereof.

In particular, the present invention relates to a device for dispensing a fluid can be applied to a container containing the fluid itself, particularly adapted to deliver food substances, perfumes or detergents in general.

DESCRIPTION OF THE STATE OF THE ART

It is known in the field of the supply of liquid products or creamy substances such as soaps, food, creams, detergents or perfumes, the use of delivery devices collapsible chamber which are applied to the vessel containing the above mentioned products.

These devices substantially consist of a support structure provided with means for coupling to the neck of the container and a delivery unit of the fluid contained in the container. The delivery unit is preferably made up of a collapsible chamber adapted to aspirate and contain a dose of the fluid coming from the container and for dispensing a portion of such a dose toward a delivery spout.

The suction of the fluid in the chamber and the supply of the same collapsible take place by manual actuation on the part of the user that acts first in compression and then in release with one or more fingers directly on a deformable membrane which delimits said chamber.

During the compression phase the fluid contained inside the collapsible chamber is delivered to the external environment through the delivery spout. In the subsequent release phase the deformable membrane automatically returns to the position not compressed by sucking a dose of fluid inside the chamber collapsible which will remain contained therein is ready for the next delivery operation.

The membrane is typically constituted by a deformable element of a hemispherical shape and therefore deformable elastically yielding adapted to be deformed from its initial hemispherical shape to a depressed position and then return to its initial form initial hemispherical after its release.

A first drawback of these dispensing devices is connected to the steps for transferring and subsequent handling its assembly to the vessel containing the product.

During the above mentioned steps, the deformable diaphragm can inadvertently undergo blows or deformations causing undesired delivery of liquid.

Another drawback of these devices is constituted by the space defined by the shape of the deformable diaphragm hemispherical. This can cause a reduced capacity storage of the device or of the assembly comprising the container and the device.

Moreover, during the storage the deformable diaphragm can undergo a deformation and a corresponding undesired delivery of liquid.

Moreover, the operations can be provided to stack a plurality of storage assemblies, the container and the relative device, one above the other and the weight could deform permanently the deformable membrane making them lose part of its characteristics of elasticity irreparably compromises its operation.

It is the aim of the invention to overcome the drawbacks described above.

More particularly a first object of the invention is to provide a collapsible chamber device for the delivery of a fluid which makes safer handling and manipulation by the user, avoiding losses of product. ,i It is a further object of the invention to provide a collapsible chamber device for the delivery of a fluid that facilitates and makes safer storage of the device once it is connected to the vessel containing the product.

SUMMARY OF THE PRESENT INVENTION

The present invention is based on the consideration generally provide a device for dispensing a fluid, said device can be connected to a container containing the fluid and operable by acting on a deformable membrane in which there are locking means adapted to maintain the membrane deformable in a depressed position locked.

According to a first embodiment, the present invention relates to a device for dispensing a fluid, said device comprising a supporting structure provided with means for coupling to a container containing said fluid and a collapsible chamber associated to said support structure suitable for aspirating, contain and dispense a dose of said fluid, said device comprising a suction duct for the communication of said chamber with said collapsible container and a delivery pipe for the communication to the outside of said chamber collapsible, said chamber being delimited at least partially by a deformable membrane adapted to be compressed for supplying at least a portion of said dose from said chamber collapsible, in which the device comprises locking means which are suitable to keep said deformable diaphragm in a depressed position locked and release means suitable to free said deformable diaphragm from said depressed position locked.

In a preferred embodiment, the locking means also comprise obstruction means adapted to obstruct said suction duct when the deformable membrane and flattened in locked position.

Preferably, the blocking means comprise snap locking means.

According to a preferred embodiment, the unlocking means comprise means for unlocking cam shaped in such a way that the movement of the membrane causes the release of the locking means in a preferred embodiment, the support structure comprises a first part and a second part connected to the first part of the said second part being movable with respect to said first part and said deformable membrane being associated with said second part, preferably the second portion being rotatable with respect to said first part.

In a preferred embodiment, the unlocking means are shaped in such a way that the movement of the second part with respect to the first part causes the release of the locking means, preferably the rotation of the second part with respect to the first part.

According to a preferred embodiment, the delivery duct, the second part and the deformable membrane are made in a single body, preferably made of PE. Preferably, the device comprises suction valve means designed to regulate the supply of the fluid in the chamber collapsible from the suction duct.

Preferably, the device comprises valve delivery means designed to regulate the supply of the fluid from the chamber collapsible with the delivery pipe.

In a preferred embodiment, the valve means comprise a flexible flap adapted to take up a closed position to prevent the passage of fluid from the chamber collapsible toward the dispensing duct and is adapted to take up an open position to allow the passage of fluid from the chamber collapsible to the delivery duct.

Preferably, the deformable diaphragm comprises a spherical portion elastically yielding associated to the support structure.

Preferably, the coupling means allow the detachable coupling of the device to the container.

In a ,suo second aspect the present invention relates to a system for the delivery of a fluid comprising a container for the fluid and a device for delivery of said fluid produced according to what is described above.

BRIEF DESCRIPTION OF THE DRAWINGS

Further advantages, objects and features as well as embodiments of the present invention are defined in the claims and will be clarified below by means of the following description, in which reference is made to the enclosed drawings; in the drawings, characteristics and/or parts corresponding or equivalent components of the present invention are identified by the same reference numerals. In particular, in the drawings:

FIG. 2 shows an exploded view of the system of FIG. 1 from a first point of;

Figure 1:
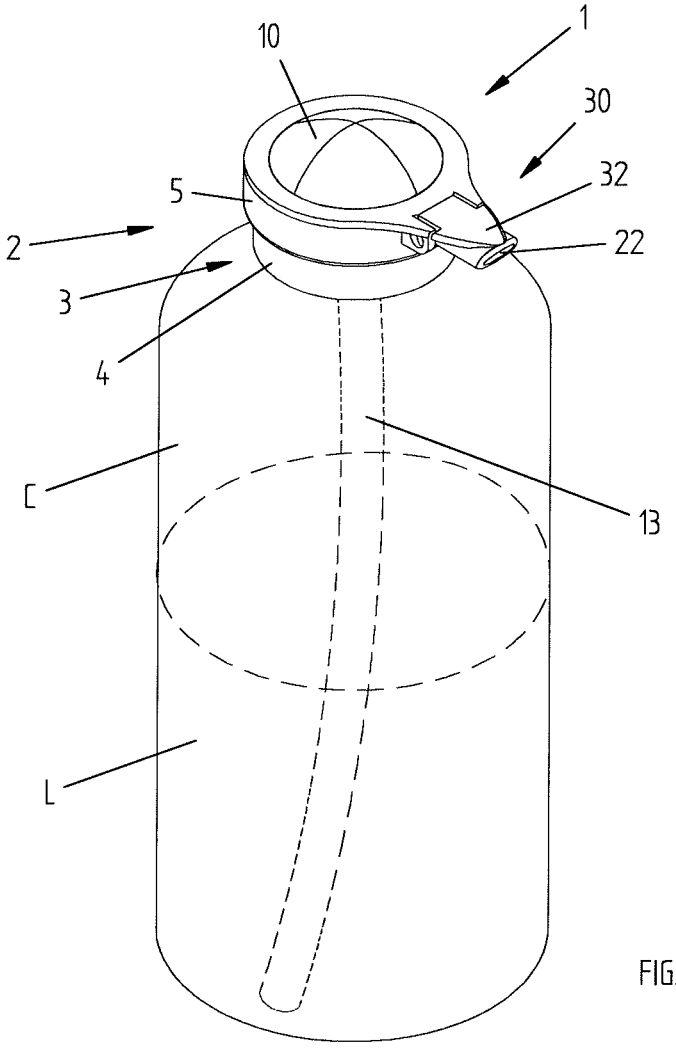
FIG. 1 shows an axonometric view of a first embodiment of the dispensing device of the invention applied to a container.
Figure 2:
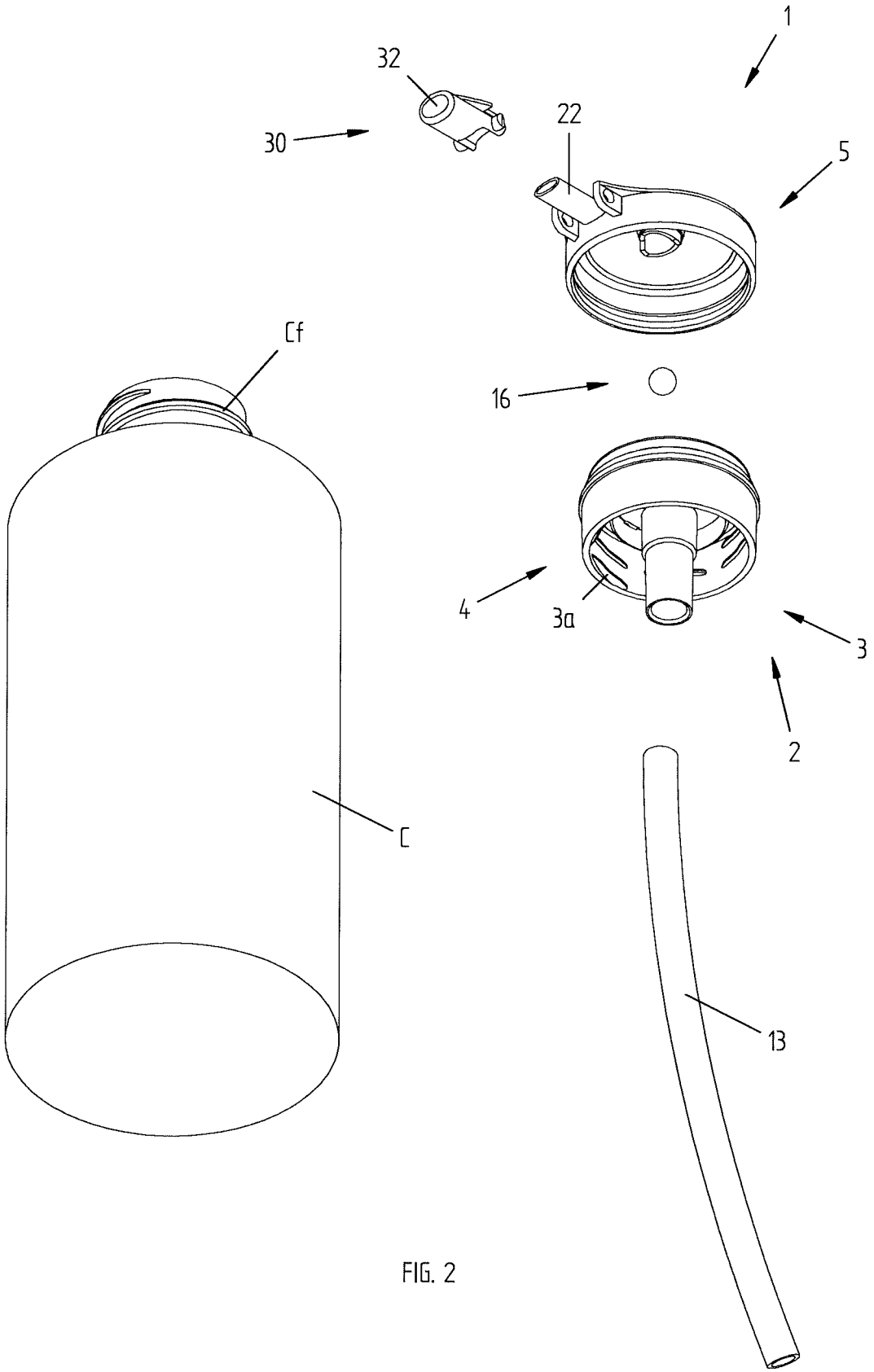
Figure 3:
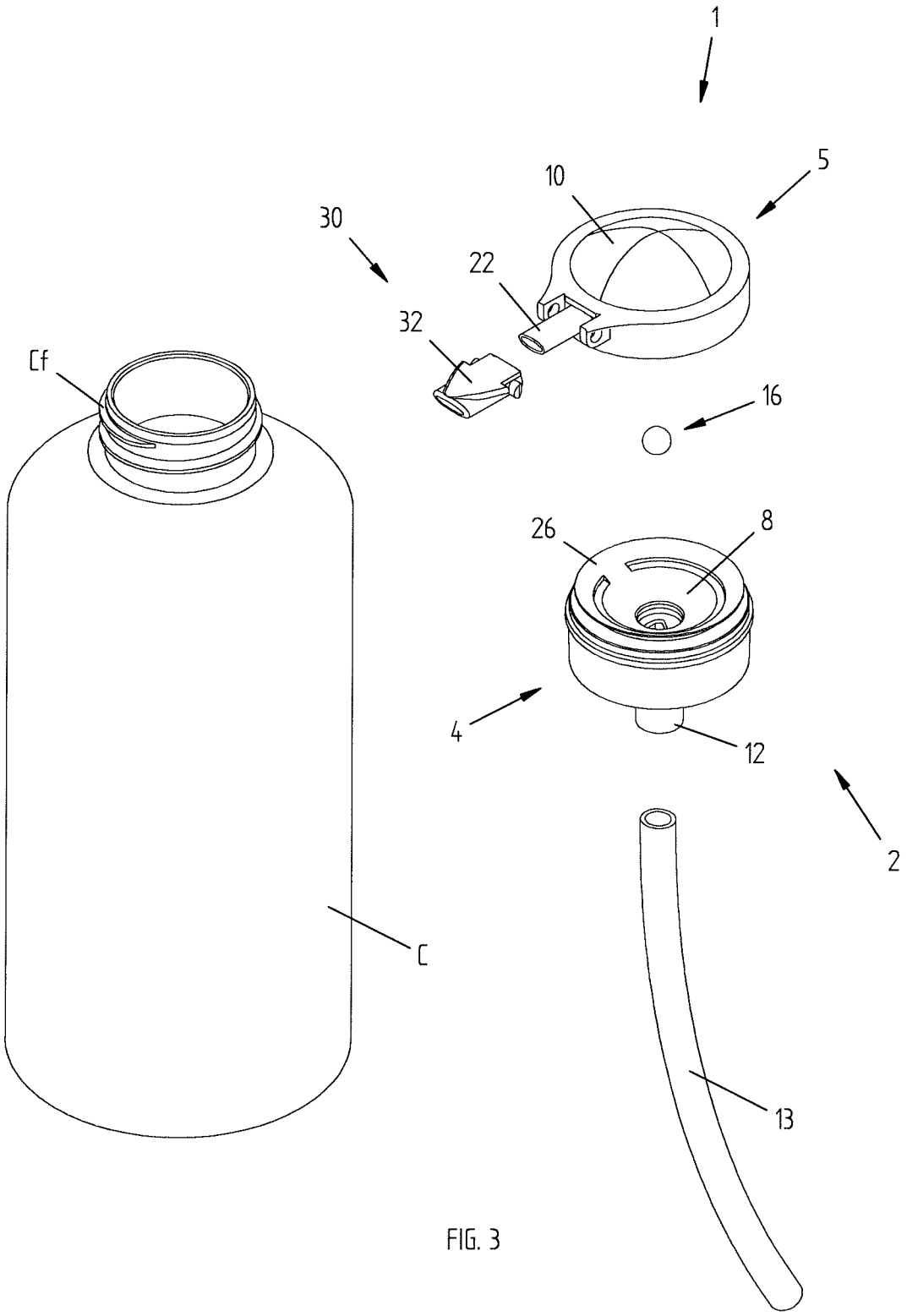
Figure 4:
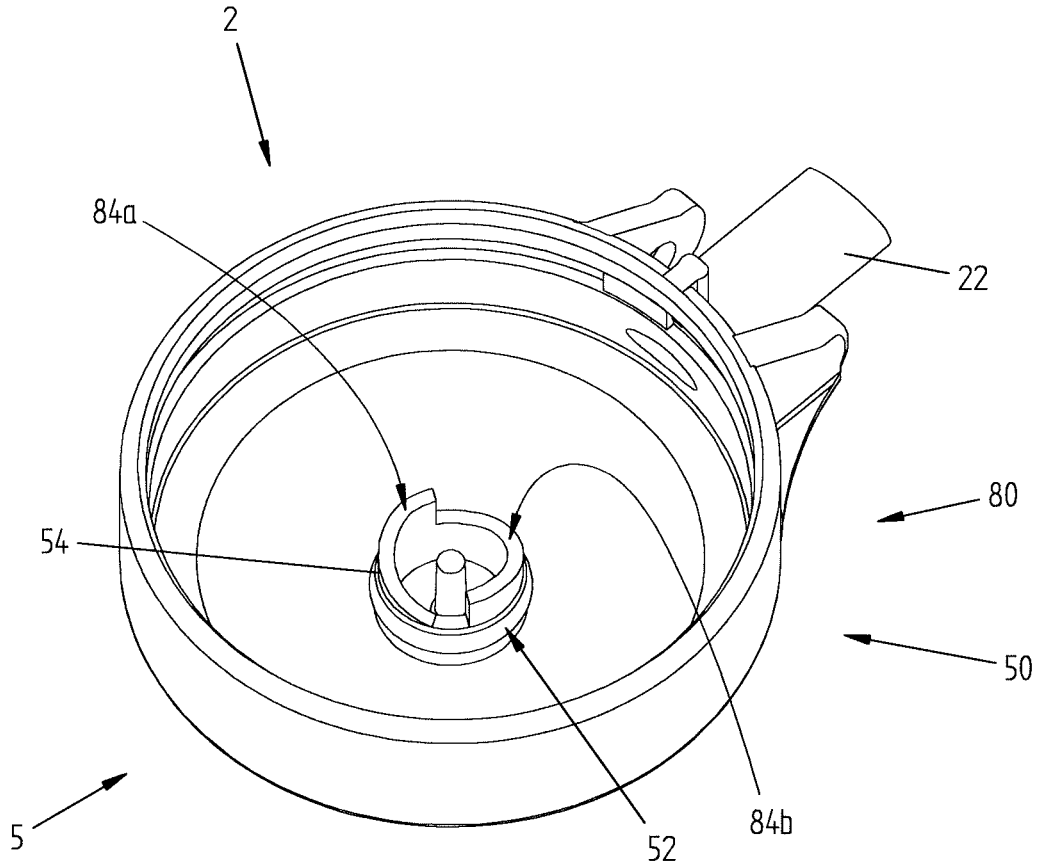
Figure 4:
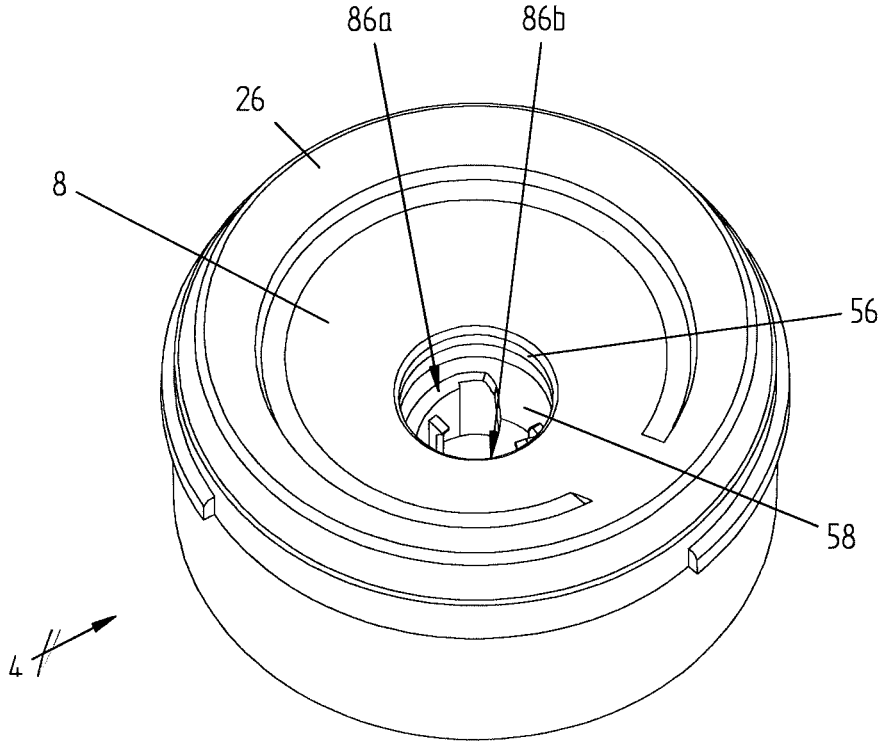
Figure 4A:
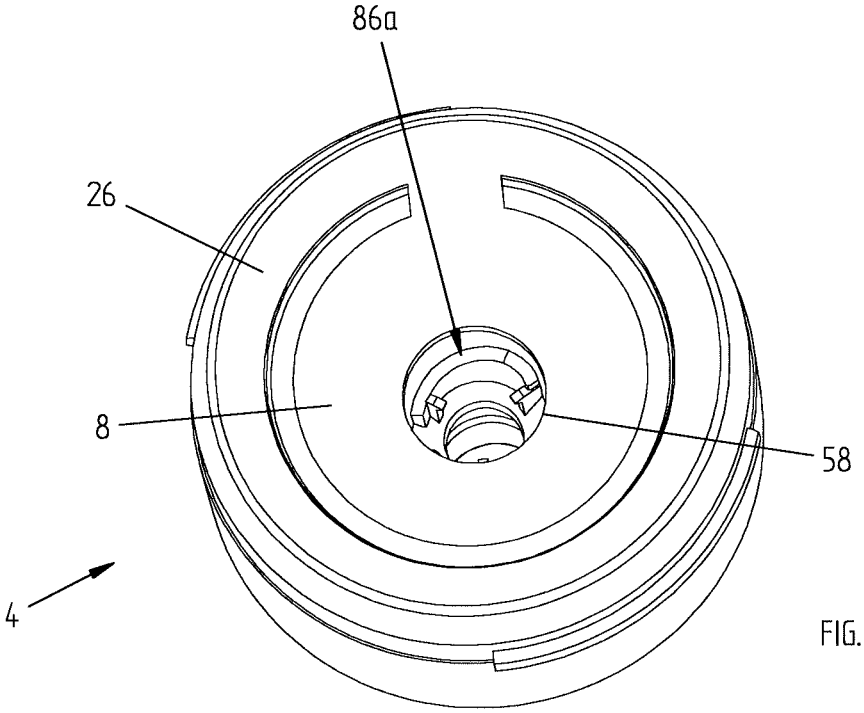
Figure 4B:
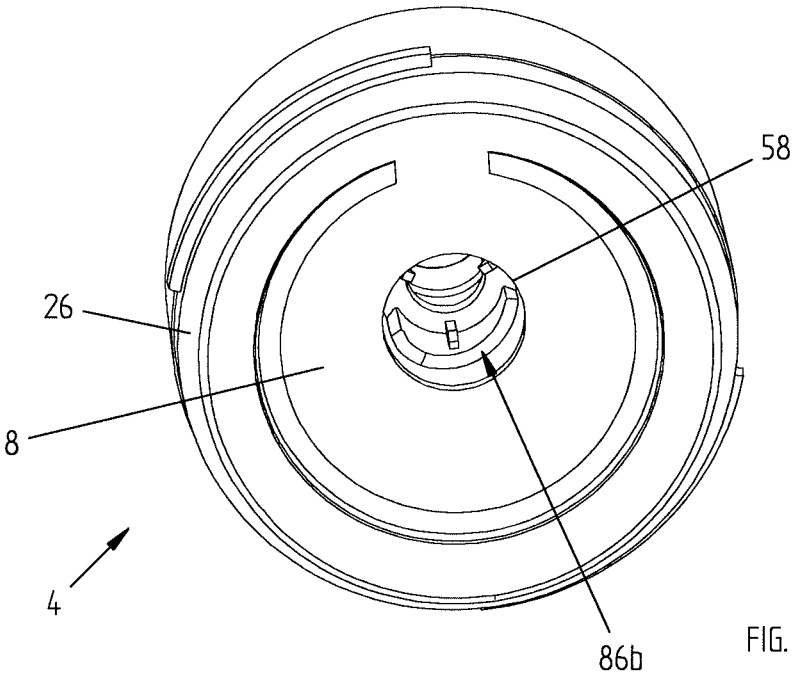
Figure 7:
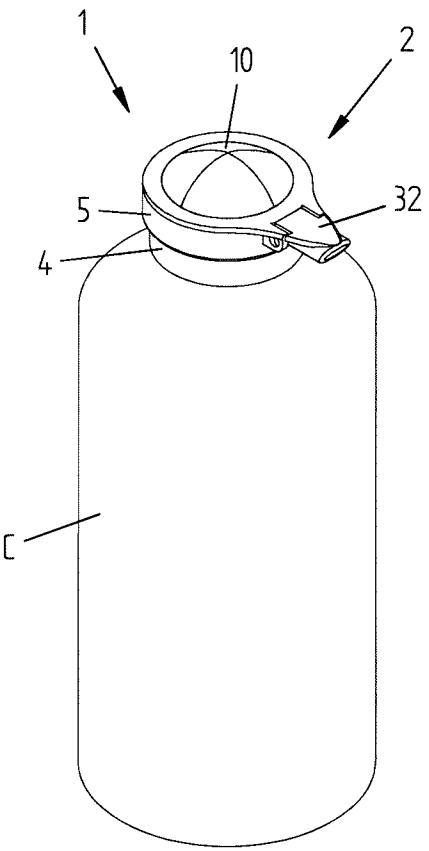
Figure 6:
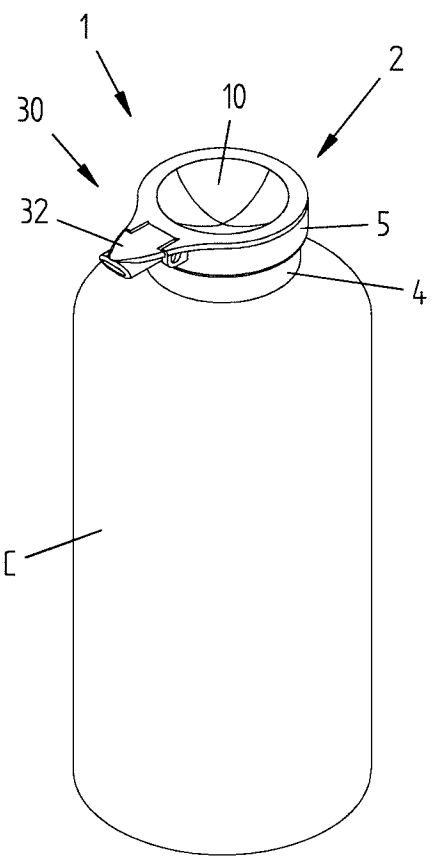
Figure 5:
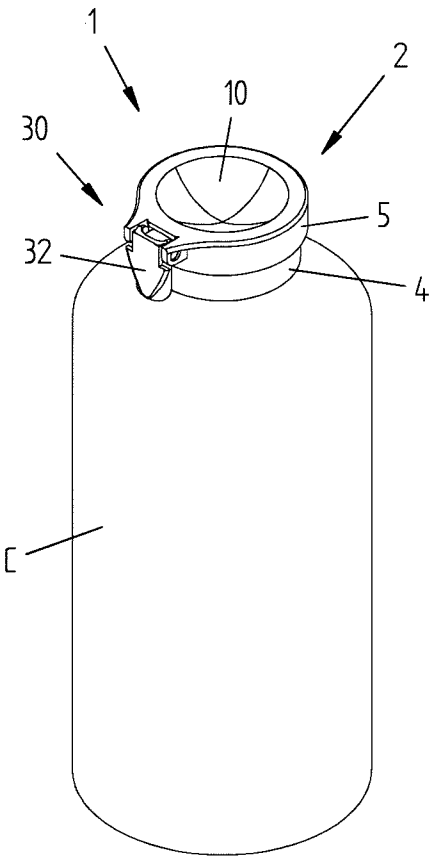
Figure 8:
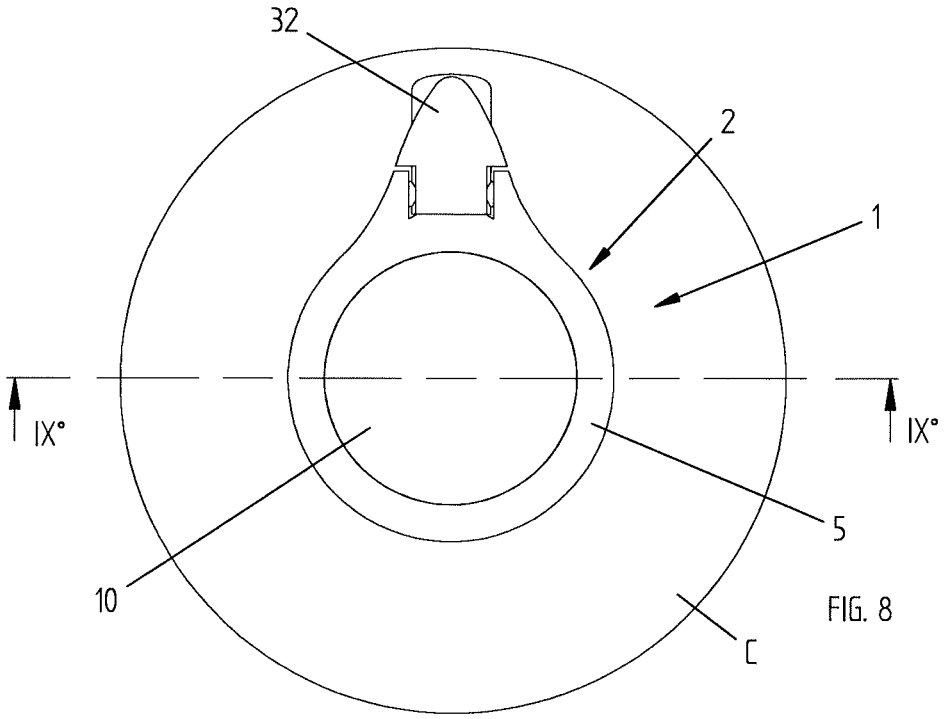
Figure 9:
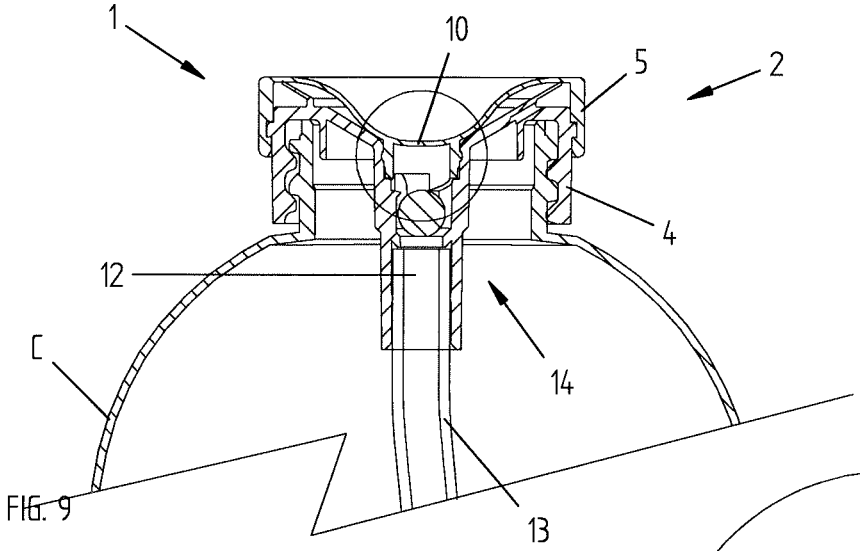
Figure 9A:
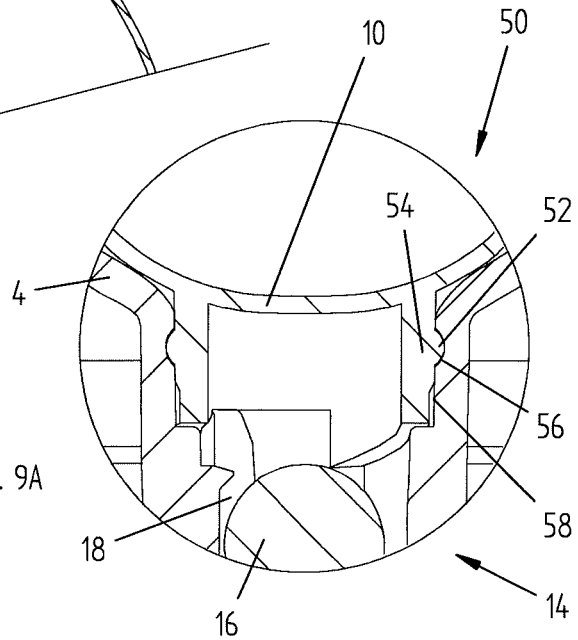
Figure 10:
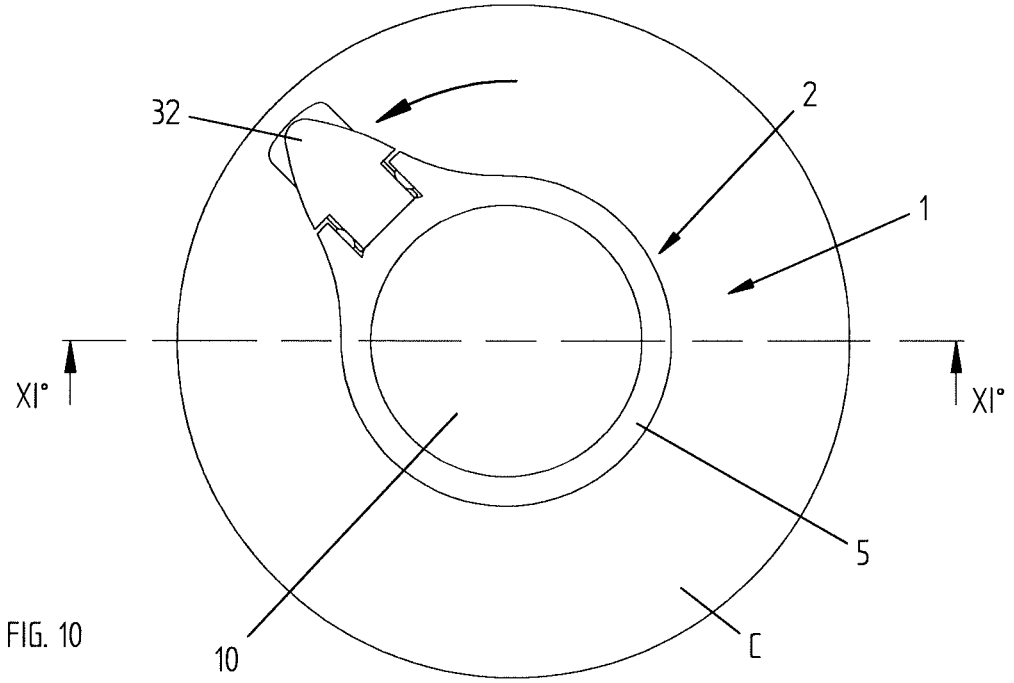
Figure 11:
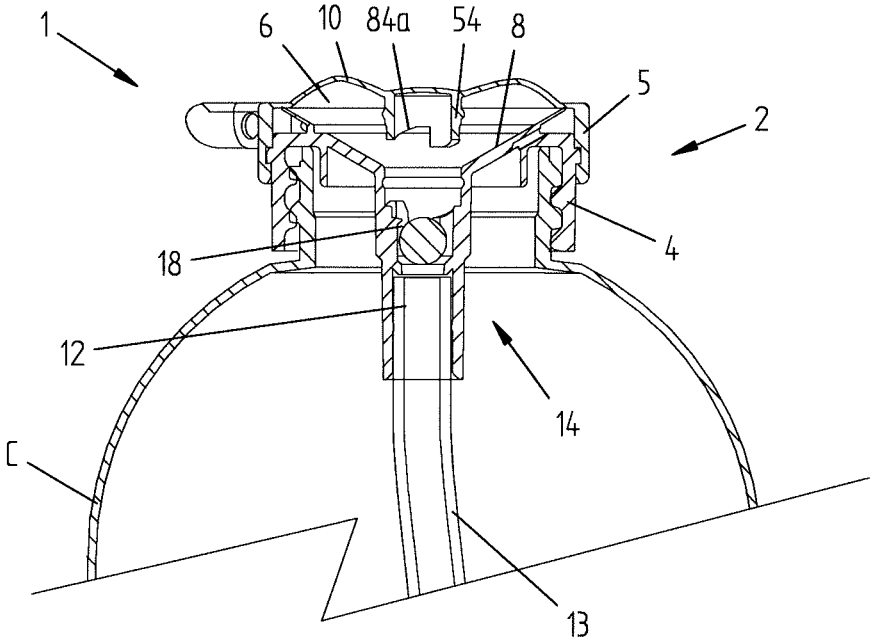
Figure 12:
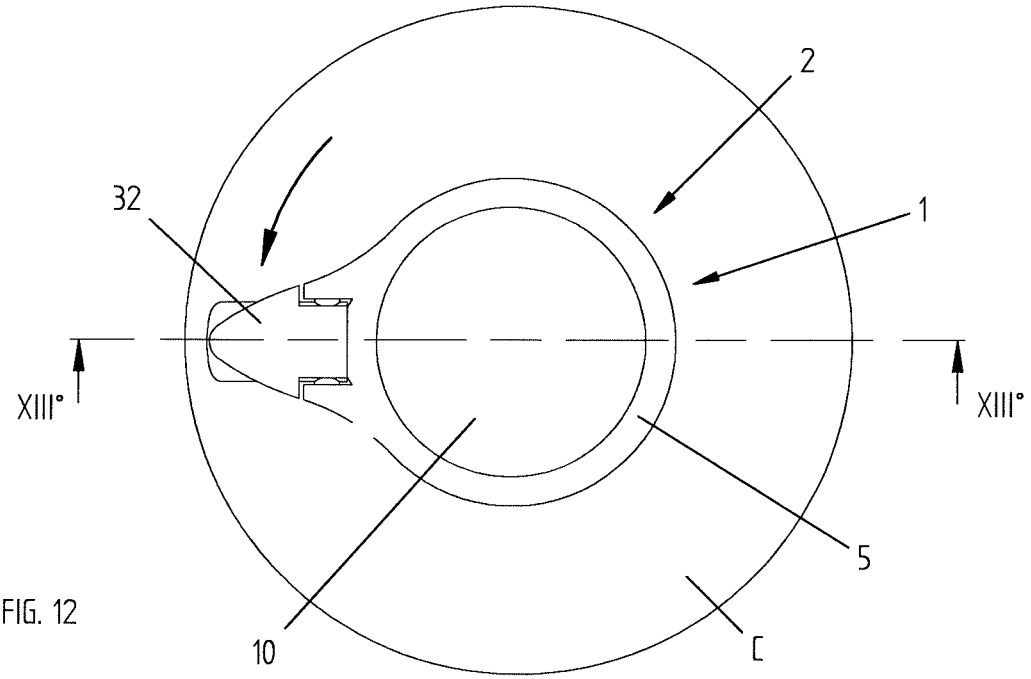
Figure 13:
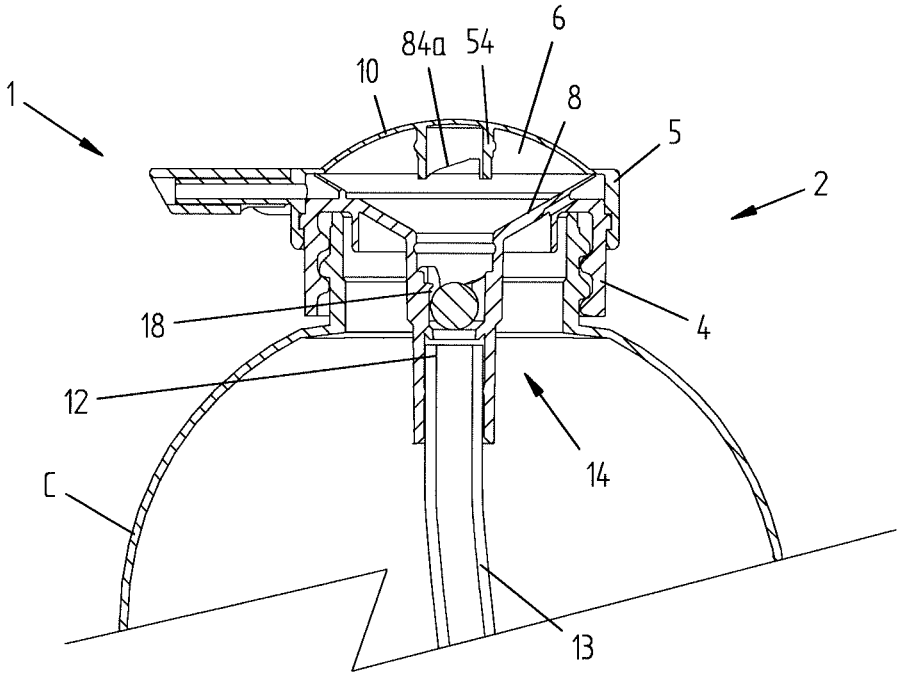
Figure 15:
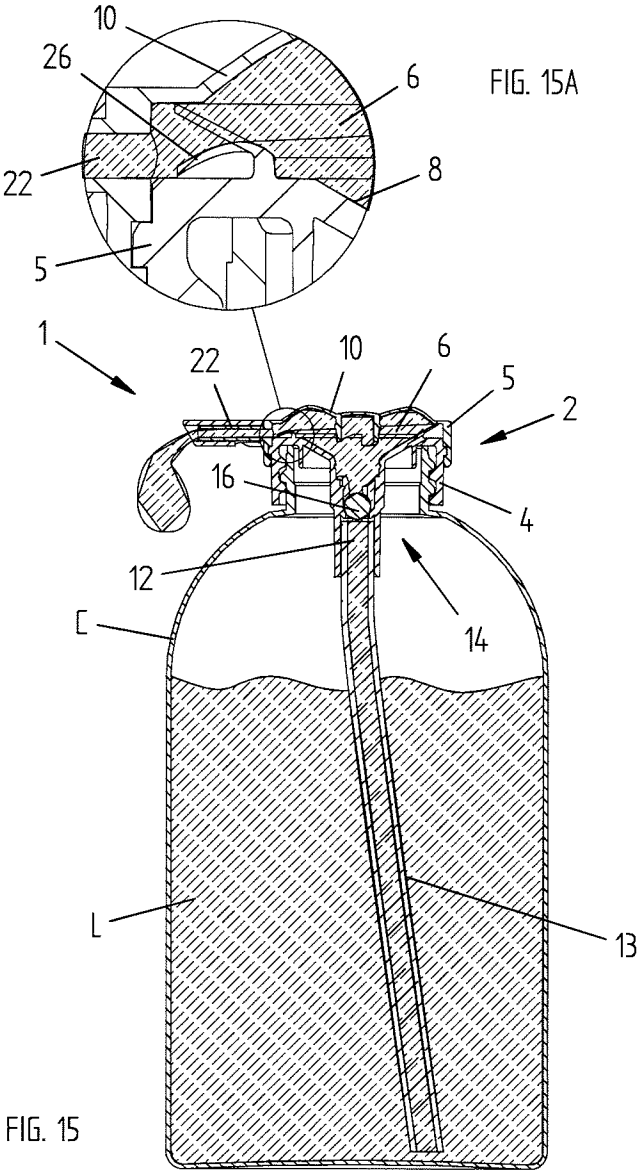
Figure 19:
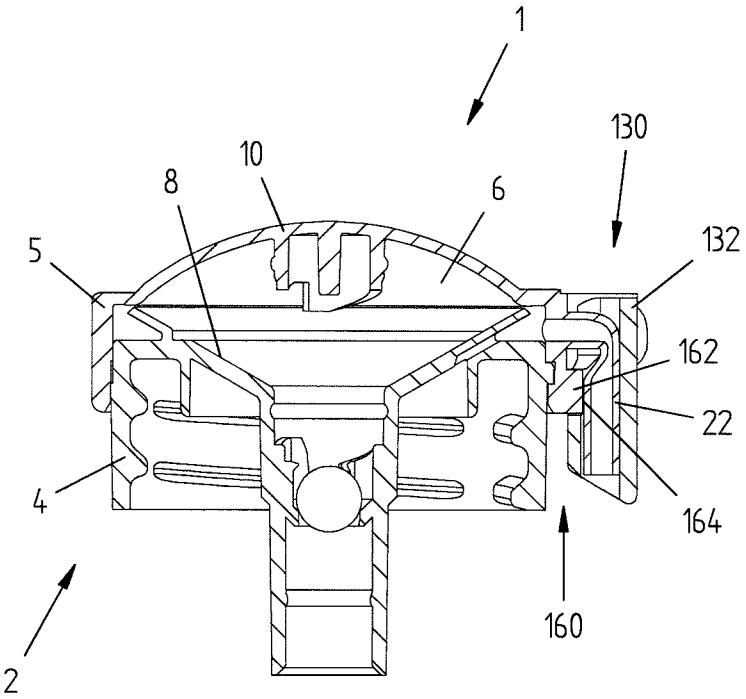
Figure 18:
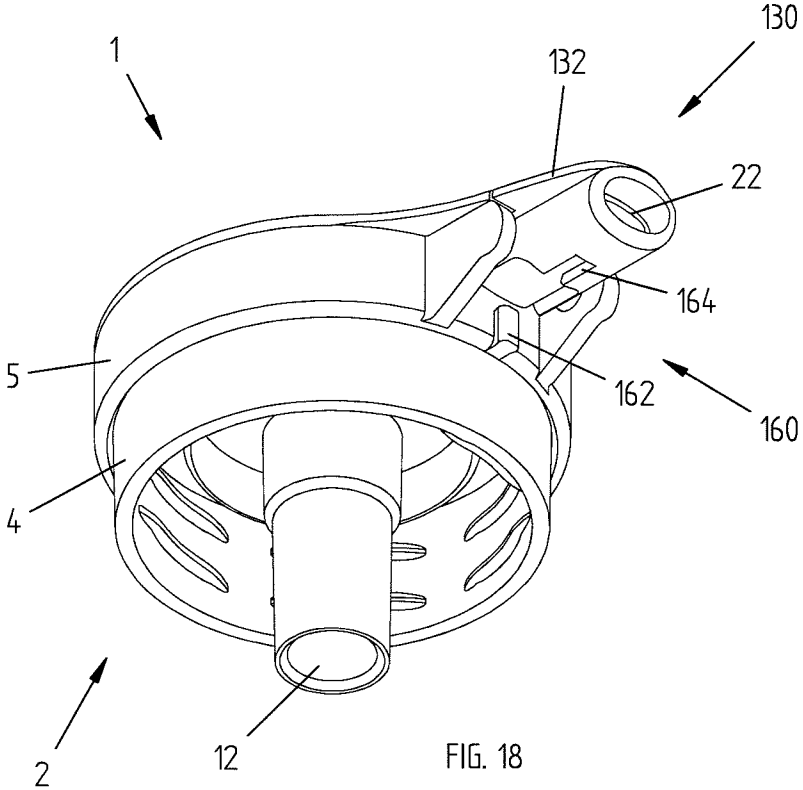

axonometric view of the device of the invention of FIG. 1;

FIG. 3 shows an exploded view of the system of FIG. 1 from a different point of view;

FIG. 4 shows in an axonometric view some elements of FIG. 2 isolated from the rest;

FIGS. 4A and 4B show an element of FIG. 4 according to two respective different points of sight; n FIGS. 5 to 7 show the assembly of FIG. 1 Different configurations according to an advantageous aspect of the present invention;

FIG. 8 shows a top plan view of the assembly of FIG. 6;

FIG. 9 is a view in section taken along the line IX°-IX° of FIG. 8;

FIG. 9A shows an enlarged detail of FIG. 9;

FIG. 10 shows a top plan view of FIG. 9 in a different operating position;

the FIG. 11 is a sectional view taken along the line XI°-XI° of FIG. 10;

FIG. 12 shows a top plan view of the assembly of FIG. 7;

FIG. 13 represents a section view along the line XII°-XIII° of FIG. 12;

FIGS. 14 to 17 represent the steps during the implementation of a system of FIG. 1;

FIGS. 15A and 16A show enlarged details of the respective FIGS. 15 and 16;

FIG. 18 shows a detail in axonometric view of a different embodiment of the device according to the invention;

FIG. 19 is a view in longitudinal section of FIG. 18.

DETAILED DESCRIPTION OF THE PRESENT INVENTION

The examples of embodiment of the invention described below refer to a device for the supply of detergents. It is clear that the solution proposed can be applied also to devices for the delivery of perfumes or food products, or any other fluid in general is taken from a container and conveyed toward the outside.

The delivery of the fluid can also be in the form of spray where the device is provided with suitable means for its generation, such as for example a diffusing element.

An example of embodiment of a device for the delivery of fluids of the present invention and applied to a container C containing a fluid L to be delivered is represented in FIG. 1, where it is indicated as a whole by the numeral 1.

The device 1 comprises a supporting structure 2 provided with means 3 for coupling to the coupling with the container C. The coupling means 3 are preferably constituted by a threaded portion 3*a*, shown in FIG. 2, adapted to be engaged with a corresponding threaded portion Cf present on the neck of the container C.

In embodiments of the invention these coupling means could be of a different type, such as for example a the snap coupling.

In general, the coupling means are preferably made to allow the detachable coupling of the device to the container.

The supporting element 2 is preferably made of two parts, a lower one 4 and an upper 5, associable to snap onto each other better illustrated in FIG. 4.

The upper part 5 is associated to the lower part 4 so that the upper part 5 can be moved with respect to the lower part 4, preferably in such a manner that the upper part 5 can rotate by a predetermined angle with respect to the lower part 4.

In the present embodiment, as described in detail later on, the upper part 5 can rotate through an angle of 90° with respect to the lower part 4.

Between the lower part 4 and the upper part 5 of the support element 2 is defined a chamber 6 suitable for aspirating, collapsible contain and dispense a dose of fluid L, as will be better described in the following.

The collapsible chamber 6 is defined at the bottom by a surface 8 preferably of truncated conical shape of the lower part 4 is delimited at the top by a deformable membrane 10.

The deformable membrane 10 is preferably made in a single body with the upper part 5.

The device 1 comprises a suction duct 12 for communication of the chamber 6 with the collapsible container C.

The suction duct 12 is preferably defined partially in the lower part 4 of the support element 2 and also preferably includes a tube 13 of predetermined length adapted to substantially reach the bottom of the container C.

In correspondence with the lower zone of collapsible chamber 6 there are suction valve means 14 disposed between the collapsible chamber 6 and the suction duct 12 adapted to regulate the flow of fluid in the chamber collapsible L 6.

The suction valve means 14 preferably comprise a ball 16 housed in a receiving portion 18 formed in the lower part 4 of the support structure 2. Within this portion of reception 18 the ball 16 can be arranged in different positions to allow the selective opening and closing of the suction pipe 12 during the actuation of the device 1 as explained in the description below.

The device 1 comprises a delivery duct 22 to the communication collapsible toward the outside of the chamber 6 and for supplying the fluid L toward the external of the device 1 and therefore toward the outside of the container C./The Preferably, the dispensing duct 22 and the upper part 5 and the deformable membrane 10 are made as a single body more preferably made of PE.

The delivery duct 22 a safety system is associated anti-delivery 30 comprising a spout 32 preferably hinged to the upper part 5 of the support element 2. The spout 32 can assume a first position in which the same anti-delivery is folded to bend and choke the dispensing duct 22, as shown for example shown in FIG. 5, and a second position in which the nozzle 32 is rotated and the dispensing duct 22 free for dispensing, as shown in FIGS. 6 and 7.

With reference to FIGS. 18 and 19 illustrate an alternative embodiment of the safety system anti-dispensing 130 that comprises retaining means 160 adapted to keep the spout 132 in the folded position.

The retainer means 160 preferably comprise means for mechanical interference comprising a projecting element 162 provided on the upper part 5 of the support structure 2 and a slot 164 formed in the bottom in the spout 132. The jutting element 162 is designed to be inserted by snap action in the slot 164.

Advantageously, when the spout 132 is brought in posizione the retainer means 160 maintain folded in a safe manner the spout 132 in such a position as shown in FIG. 19.

At the moment of use of the device 1, it is up to the user release the spout 132 by rotating it and bringing it in a horizontal position.

At the upper region of the chamber 6 there are collapsible dispensing valve means 24 arranged between the chamber 6 and the collapsible dispensing duct 22 able to regulate the flow of fluid collapsible L from the inside of the chamber 6 toward the dispensing duct 22 and then toward the outside.

The delivery valve means 24 preferably comprise a flexible flap 26 belonging to the lower part 4 of the support element 2 adapted to take up a closed position to prevent the passage of fluid collapsible L from the inside of the chamber 6 toward the outside and is adapted to take up an open position to allow the passage of fluid collapsible L from the inside of the chamber 6 the delivery duct 22 and then toward the outside of the container C as shown for example in the detail of FIG. 15A and better described in the following).

The deformable membrane 10, preferably of a hemispherical shape and elastically yielding and hence deformable.

The deformable membrane 10 is suitable to be compressed to deliver an amount of fluid from the chamber collapsible L 6.

With reference to FIGS. 14 to 17 will be described in the following the operating phases of the device 1 of the invention 1 during its normal use.

According to one aspect of the present invention, the device comprises locking means 50 suitable for maintaining the deformable membrane 10 in a depressed position locked.

A depressed position locked of the deformable diaphragm 10 according to the invention is shown in the FIGS. 5, 6 and in the FIGS. 8, 9 and 9A.

The depressed position locked of the deformable diaphragm 10 and a position in which the membrane 10 is arranged before the use of the device 1. Preferably the deformable membrane 10 is placed in this position from the producer/aggregator immediately after filling of the container C with the fluid L or is arranged in this position from the producer/assembler of the device 1 which is then mounted to the container C with the fluid F.

According to an aspect of the invention, the device 1 further comprises release means 80 suitable to free the deformable membrane 10 from the depressed position locked.

The free/unlocked position of the deformable diaphragm 10 is shown for example in FIG. 7.

Following the operation of the unlocking means 80, the device 1 can be used normally, as will be described below.

The locking means 50 according to the present preferred embodiment shown and described preferably comprise a snap locking system.

The locking means 50, better visible in FIG. 4, preferably includes a projecting annular edge 52 preferably defined on the outer surface of a peduncle 54 which extends toward the chamber 10 by the deformable diaphragm 6 collapsible, and a corresponding recessed annular edge 56 preferably made of a cylindrical seat 58 of the lower part 4 of the support element 2.

The annular rim projecting 52 is inserted with a snap in recessed annular edge 56 with a given force by pressing the deformable membrane 10 and the itself is kept in depressed position locked.

In embodiments of the invention the snap locking system can be made in a different way, for example with different geometries of the edges or by reversing the positions of the edge projecting respect to recessed edge.

Preferably the cylindrical seat 58 of the lower part 4 on which the recessed annular edge 56 is made in correspondence with the end part of the suction duct 12 to the chamber 6 collapsible.

Advantageously, with the deformable diaphragm 10 in depressed position locked the peduncle 54 by the deformable diaphragm 10 is inserted in the cylindrical seat 58 in such a way as to obstruct the suction duct 12.

Advantageously, the locking means 50 in addition to ensure the locking of the deformable diaphragm 10 in depressed position desired hydraulic, ensure the closure of the suction pipe 12 preventing the seepage of fluid L from the container C.

In embodiments of the invention however, said characteristic hydraulic closure could not be present.

The unlocking means 80 according to the preferred embodiment shown and described preferably comprise a cam release system.

The locking means 80, better visible in the FIGS. 4, 4A and 4B preferably comprise two inclined surfaces 84*a*, 84*b* formed at the end of the extension 54 and corresponding inclined surfaces 86*a*, 86*b* made in the cylindrical seat 58 of the lower part 4 of the support element 2.

When the deformable membrane 10 is in its locked position flattened, the inclined surfaces 84*a*, 84*b* of the extension 54 and the corresponding inclined surfaces 86*a*, 86*b* of the cylindrical seat 58 contact. With the deformable diaphragm 10 in its depressed position locked, the upper part 5 of the support element 2 is arranged with respect to the lower part 4 with a predetermined orientation, as shown for example in the FIGS. 5, 6 and 8.

To operate the release means 80, the upper part 5 of the support element 2 is rotated with respect to the lower part 4, as can be seen by comparing the FIGS. 8 to 13.

In the embodiment illustrated herein, the upper part 5 of the support element 2 is rotated by 90° with respect to the lower part 4. In embodiments of the invention however, the amount of rotation may be different.

During the rotation of the upper part 5, the inclined surfaces 84*a*, 84*b* of the extension 54 and the corresponding inclined surfaces 86*a*, 86*b* of the cylindrical seat 58 interact (cam) effect and the stem 54 together to the deformable membrane 10 is pushed in the direction of removing it from cylindrical seat 58 or in other words the deformable membrane 10 is released from its depressed position locked/released by extracting the annular edge 52 of the protuberance 54 projecting from the edge 56 of the cylindrical seat 58 recessed annular.

Such unlocking of the deformable diaphragm 10 occurs during the first stage of rotation of the upper part 5 with respect to the lower part 4, for example after a rotation of about 10°. Once released, the deformable diaphragm 10 thanks to its elasticity | is automatically set in fully expanded position ready for the normal use, as shown in FIG. 13.

Simultaneously the removal of the peduncle 54 cylindrical seat 58 which is free from the suction duct 12.

According to the embodiment described herein, there are provided four inclined surfaces in order to obtain the effect cam. In embodiments of the invention may also be provided a different number of inclined surfaces, and in the limit even just one.

From the above description, advantageously, the locking means 50 allow to position the deformable membrane 10 in a depressed position locked before the use of the device 1. Preferably, as mentioned above, the deformable membrane 10 is positioned to the depressed position locked by the producer/aggregator immediately after filling of the container C with the fluid L or producer/assembler of the device 1.

Advantageously avoids undesired delivery of liquid, in particular during its transport or handling of the user before its actual use.

Moreover, the depressed position locked 50 of the deformable diaphragm 10 reduces the overall dimensions of the device 1 by increasing the storage capacity of the device 1 or of the assembly comprising also the container C. Besides, the storage, there is no need to worry about the storage position of the assembly can also be arranged upside down.

Still, the depressed position locked 50 of the deformable diaphragm 10 allows the storage of more assemblies, the container C and the relative device C, stacked one on top of the other without worrying that the weight deformed in a permanent manner the deformable membrane 10. The storage, the transportation and the handling on the part of the user are therefore safe and facilitated as compared to the systems of a known type.

With reference to FIGS. 14 to 17 in the following there are disclosed the operating phases of the device 1 of the invention, after the deformable membrane 10 is unlatched.

Figure 14:
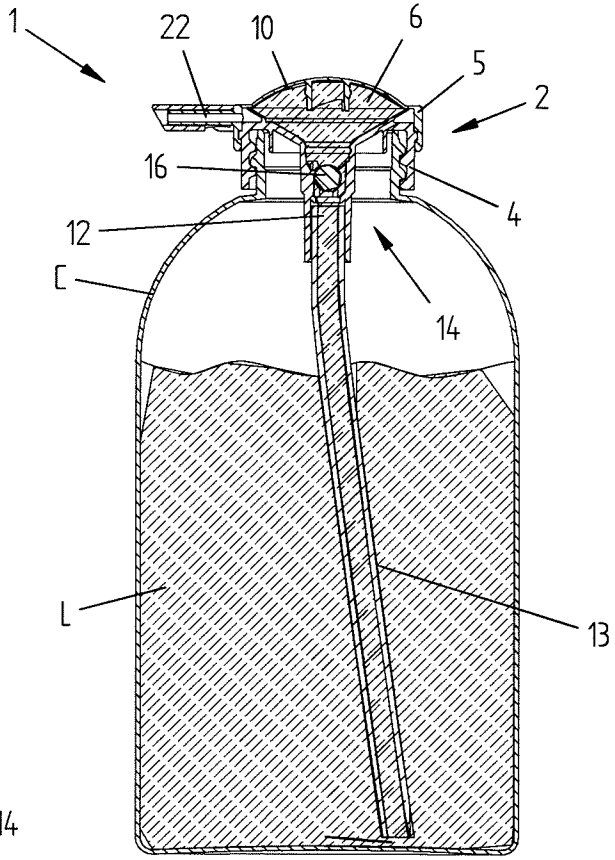

In FIG. 14 the device 1 is in a rest condition ready for use with the deformable diaphragm 10 fully expanded.

In the rest condition of FIG. 14 is already assumes the presence of fluid collapsible L inside the chamber 6, being this the operating condition which occurs in the normal use of device 1, except when it is used for the first time and the chamber is still empty collapsible.

FIG. 15 shows the first phase of operation of the device 1 in which the deformable membrane 10 is squeezed.

The thrust on the deformable diaphragm 10 increases the pressure inside the chamber 6 and the collapsible flexible flap 26 undergoes a deformation by providing an opening toward the dispensing duct 22 (as better shown in FIG. 15A).

During this stage the ball 16 blocks the suction duct 12 so that the fluid collapsible L from the inside of the chamber 6 is compressed and pushed only toward the dispensing duct 22.

This situation continues until the deformable membrane 10 reaches its end stop position, as shown in FIG. 16.

The end of stroke is preferably defined by the contact between the lower surface 92 of the extension 54 against an abutment surface 90 of the lower part 4 of the supporting element 2, as shown in the detail of FIG. 16A. It is clear that in different embodiments the end of stroke position can be obtained by different means.

At the end of the compression phase there will be a predetermined amount of fluid L collapsible delivered from the chamber 6 to the outside through the dispensing duct 22.

It is obvious that the amount of fluid delivered may be of a smaller amount L if the deformable membrane 10 is released before to reach the end of stroke position. After completion of the step of supplying the fluid L, starts the phase of the release of the deformable diaphragm 10 which coincides with the step of suction of the fluid from the container C L to reintegrate the quantity of fluid collapsible L inside the chamber 6 to be used for subsequent delivery.

In FIG. 17 there is shown the release step in which the flexible flap 26, between the other is shown in the closed position of the delivery duct 22.

The ball 16 due to the effect of the decompression chamber in collapsible, 6 is drawn upwards by opening above the suction duct 12.

The deformable membrane 10 decompresses automatically thanks to its intrinsic characteristics of elastic compliance and the fluid L C is aspirated from the inside of the container along the intake duct 12 inside the chamber 6 collapsible.

At the end the volume of the chamber 6 is totally collapsible restored and the ball 16 is again arranged in occlusion of the suction pipe 12 and the device 1 returns to the initial condition, that is shown in FIG. 14 with the collapsible chamber 6 filled with a dose of fluid L the usable for subsequent delivery.

It can therefore be seen that the present invention allows to achieve the intended aim and objects. In particular makes it possible to achieve a device for dispensing a fluid that makes safer its transport and its handling on the part of the user as compared to the systems of a known type.

While the present invention has been described with reference to particular embodiments shown in the figures, it is to be noted that the present invention is not limited to the particular embodiments shown and described; on the contrary, further variations of the described embodiments are within the scope of the present invention, the object defined by the claims.

For example, in the description of the present invention reference is made to the operation of the deformable diaphragm directly on the part of the user. In embodiments of the invention however, the deformable diaphragm could be flattened with the use of auxiliary means, for example, by means of a lever or equivalent means.

The invention claimed is:

1. A device for dispensing a fluid, said device comprising:

a supporting structure coupled with a container holding said fluid, a collapsible chamber associated with said supporting structure, said collapsible chamber being suited to draw, contain and dispense a dose of said fluid, a suction duct configured to allow said collapsible chamber to communicate with said container and a dispensing duct configured to allow said collapsible chamber to communicate with an external environment, wherein said collapsible chamber is being at least partially delimited by a deformable membrane configured to dispense at least one portion of said dose from said collapsible chamber, wherein the deformable membrane includes a snap-fitting lock configured to maintain said deformable membrane in a locked squeezed position and to release said deformable membrane from said locked squeezed position upon rotation of the supporting structure, and wherein the snap-fitting lock is released by a camming surface formed on the snap-fitting lock.

2. The device according to claim 1, wherein said snap-fitting lock includes an obstruction element configured to obstruct said suction duct when said deformable membrane is in said locked squeeze position.

3. The device according to claim 1, wherein said snap-fitting lock comprises a stem having a projecting annular edge formed on the deformable membrane received within a recessed annular edge formed in the supporting structure.

4. The device according to claim 1, wherein said supporting structure comprises a first part and a second part connected to said first part, said second part being movable with respect to said first part and said deformable membrane being associated with said second part.

5. The device according to claim 4, wherein the snap-fitting lock is released by a camming surface formed in the snap-fitting lock and said camming surface is so that movement of said second part with respect to said first part releases the deformable membrane.

6. The device according to claim 4 wherein said dispensing duct, said second part and said deformable membrane are made in a single body of polyethylene.

7. The device according to claim 1, further comprising a suction valve configured to regulate the flow of said fluid into said collapsible chamber from said suction duct.

8. The device according to claim 1, further comprising a dispensing valve configured to regulate the flow of said fluid dispensed from said collapsible chamber into said dispensing duct.

9. The device according to claim 8, wherein said dispensing valve includes a flexible edge configured with a closed position to prevent the fluid from passing from said collapsible chamber into said dispensing duct and an open position to allow the fluid to pass from said collapsible chamber into said dispensing duct.

10. The device according to claim 1, wherein said deformable membrane comprises an elastically yielding ball-shaped portion associated with said supporting structure.

11. The device according to claim 1, wherein the supporting structure is removably coupled with said container.

12. The device according to claim 3, wherein the projecting annular edge includes at least one inclined surface configured to release the deformable membrane from said locked squeezed position upon rotation of the supporting structure.

* * * * *